US008225823B2

(12) United States Patent
Lin

(10) Patent No.: US 8,225,823 B2
(45) Date of Patent: Jul. 24, 2012

(54) HAND SANITIZER DEVICE FOR FUEL PUMP DISPENSER

(75) Inventor: Daniel J. Lin, San Francisco, CA (US)

(73) Assignee: Daniel J. Lin, San Francisco, CA (US)

( * ) Notice: Subject to any disclaimer, the term of this patent is extended or adjusted under 35 U.S.C. 154(b) by 506 days.

(21) Appl. No.: 12/582,882

(22) Filed: Oct. 21, 2009

(65) Prior Publication Data

US 2011/0088809 A1 Apr. 21, 2011

(51) Int. Cl.
*B65B 1/04* (2006.01)

(52) U.S. Cl. ..... 141/98; 141/360

(58) Field of Classification Search ..... 141/98, 141/360

See application file for complete search history.

(56) References Cited

U.S. PATENT DOCUMENTS 4,921,150 A * 5/1990 Lagergren et al. ..... 222/639
5,890,520 A * 4/1999 Johnson, Jr. ..... 141/94

OTHER PUBLICATIONS

"Does your gas pump ever make you feel wet and sticky"; '15 Minute Lunch'; Johnny Virgil; first published online Jun. 27, 2005.*

* cited by examiner

*Primary Examiner* — Gregory Huson
*Assistant Examiner* — Jason K Niesz
(74) *Attorney, Agent, or Firm* — Patterson & Sheridan, LLP

(57) ABSTRACT

A hand sanitizer compartment is embedded into a fuel pump dispenser to provide a patron with the option to cleanse his hands after pumping fuel. The hand sanitizer compartment includes a hand sanitizer dispenser that includes a circuit configured to receive an activation signal from a computer system of the fuel pump dispenser when a patron request access to the hand sanitizer dispenser.

14 Claims, 3 Drawing Sheets

HAND SANITIZER DEVICE FOR FUEL PUMP DISPENSER

BACKGROUND

Hand sanitizer dispensers are increasingly being placed in indoor facilities, such as retail store and supermarket entrances, business lobbies, airport gates and hospital service desks. Proprietors of such indoor facilities provide these hand sanitizer dispensers as a benefit to their customers to encourage cleanliness inside the facilities and reduce the spread of pathogens. However, to date, hand sanitizer dispensers have not been as prevalently offered in outdoor public locations, in part, due to the difficulty in controlling abusive use of the dispensers (e.g., excessive use, by passersby and non-customers, etc.) and the need to environmentally harden the dispensers. In particular, fuel pump dispensers at gas stations are an ideal environment to offer hand sanitizer dispensers. Due to heavy use, fuel pump handlers tend to be extremely dirty. What is needed as a fuel pump dispensers that includes a hand sanitizer dispenser.

SUMMARY

One or more embodiments of the present invention provide a hand sanitizer device comprising a compartment embedded into a fuel pump dispenser and a hand sanitizer dispenser in the compartment space. In one embodiment, the hand sanitizer dispenser comprises an activation circuit for activating dispensing capabilities of the dispenser. The activation circuit is configured to receive an activation signal from a computer system coupled to the fuel pump dispenser and activate the hand sanitizer dispenser in response to the receipt of the activation signal. Similarly, the activation circuit is further is further configured to receive a deactivation signal from the computer system and deactivate the hand sanitizer dispenser in response to receipt of the deactivation signal. Alternatively, the hand sanitizer dispenser may further comprise a timer circuit for initiating a pre-determined time interval and deactivating the hand sanitizer dispenser upon an expiration of the time interval.

DETAILED DESCRIPTION

Figure 1:
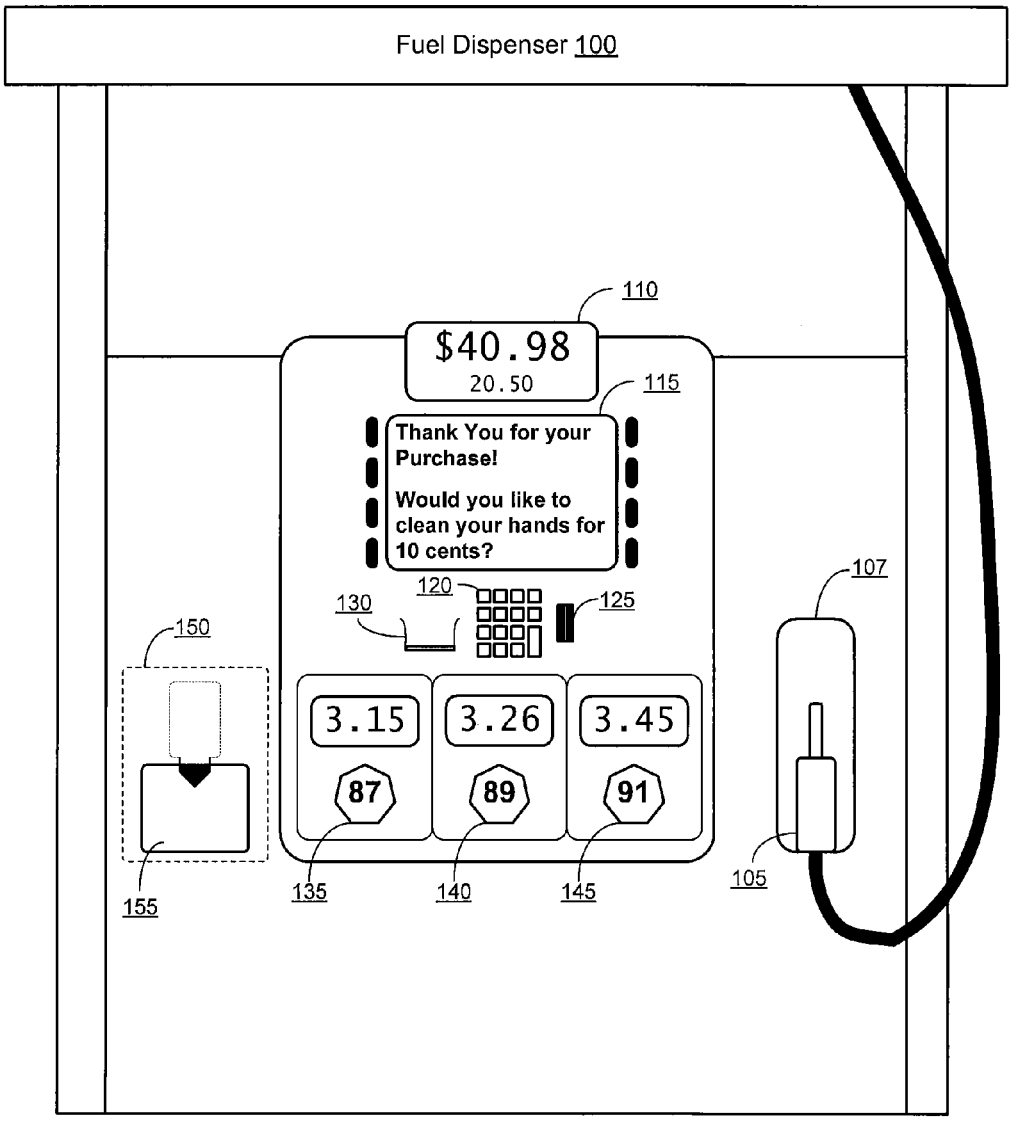
FIG. 1 depicts a fuel pump dispenser including a hand sanitizer dispenser.

FIG. 1 depicts a fuel pump dispenser including a hand sanitizer dispenser. Fuel pump dispenser 100 includes a fuel pump 105 and a price and pumped fuel amount monitor 110. Fuel pump 105 is kept in return carriage 107 when not in use. Fuel pump dispenser 100 further includes a media system display (e.g., touch screen) 115 that displays information to a customer, including, for example, promotions, advertisements and fuel pump instructions and messages. For payment transaction purposes, fuel pump dispenser 100 further includes a keypad 120, bar code and/or magnetic stripe scanner (e.g., for credit cards and identification) 125, and printer output (e.g., for receipts, etc.) 130. For fuel grade selection purposes, fuel pump dispenser 100 further includes three fuel grade selection buttons, 135-145, respectively. Fuel pump dispenser also includes a hand sanitizer compartment 150 that includes an opening 155 that provides access to a hand sanitizer, such as a liquid gel or a moist towelettes. It should be recognized fuel pump dispenser 100 is simply an example of a fuel pump dispenser that may incorporate a hand sanitizer compartment as discussed herein, and that any fuel pump dispenser may be used, consistent with the teachings herein.

Figure 2A:
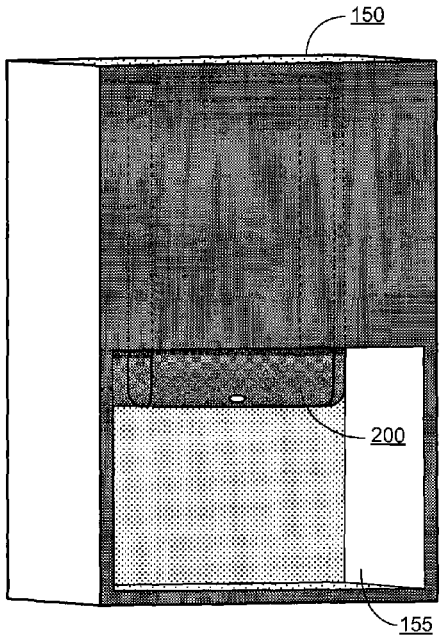
FIGS. 2A-2D depicts alternative embodiments of a hand sanitizer compartment embedded into a fuel pump dispenser.
Figure 2B:
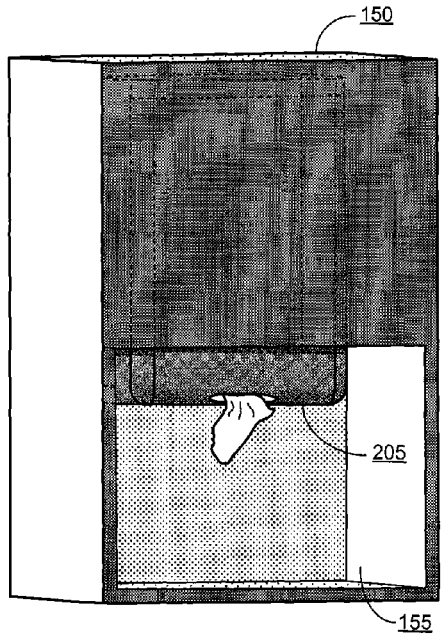

FIGS. 2A through 2D depict various embodiments of a hand sanitizer compartment embedded into a fuel pump dispenser. FIG. 2A depicts a hand sanitizer compartment 150 that supports a touch free hand sanitizer 200. When a hand is placed into opening 155 underneath touch free hand sanitizer 200, touch free hand sanitizer 200 automatically dispenses a portion of sanitizing gel or foam (or any other type of sanitizing product) into the hand (e.g., via an infrared sensor, motion sensor, capacitive flux sensor, etc.). Such a touch free hand sanitizer 200 may be powered by batteries or otherwise coupled to fuel pump dispenser 100 for a power source. In one embodiment, touch free hand sanitizer 200 further includes a timing, sensing and/or activation circuit that is configured so that touch free hand sanitizer 200 is only activated to dispense sanitizing product when a patron completes fueling of his vehicle and returns fuel pump 105 to return carriage 107. FIG. 2B depicts a hand sanitizer compartment 150 that supports a moist towelette or clean wipe dispenser 205. A patron reaches into opening 155 and takes a most towelette or clean wipe (sealed or unsealed) from dispenser 205.

Figure 2C:
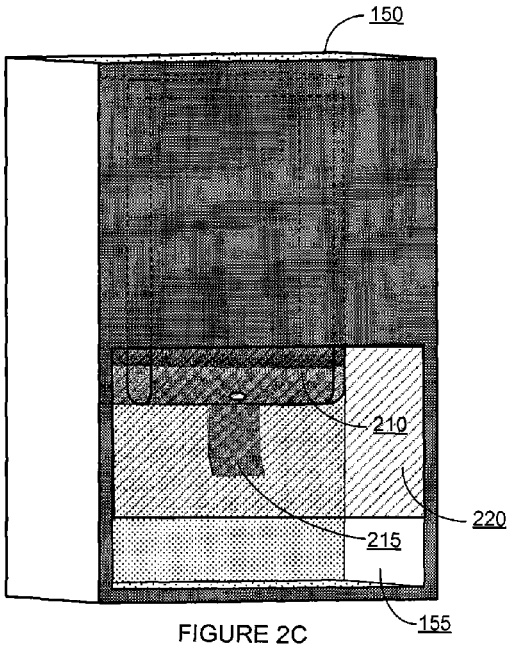
Figure 2D:
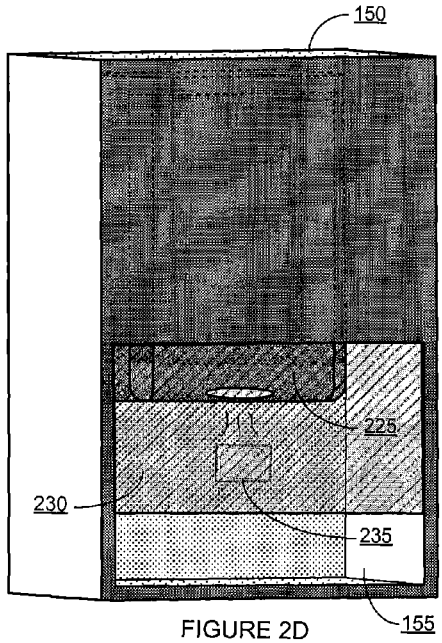

FIG. 2C depicts a hand sanitizer compartment 150 that supports a manual hand sanitizer 210 that dispenses a portion of sanitizing gel or foam when its lever 215 is depressed. The hand sanitizer compartment 150 of FIG. 2C also includes a transparent pane 220 that opens and closes to protect the hand sanitizer from the external environment and unfettered access to the hand sanitizer. In one embodiment, transparent pane 220 automatically retracts upward when a patron completes fueling his vehicle and returns fuel pump 105 to return carriage 107. Transparent pane 220 automatically closes after a pre-determined time interval or after a motion sensing mechanism (e.g., infra-red sensor, etc.) of compartment 150 recognizes that the patron's hand has been removed from opening 155. In an alternative embodiment, transparent pane 220 can be manually opened or closed and may be automatically unlocked when a patron completes fueling his vehicle and returns fuel pump 105 to return carriage 107 (and locked after the patron completes accessing the hand sanitizer). FIG. 2D depicts a hand sanitizer compartment 150 that supports a sealed moist towelette dispenser 225 and a transparent pane 230. In one embodiment, dispenser 225 automatically dispenses a sealed moist towelette 235 upon request by a patron (e.g., after requesting one by interacting with media system 115) after completion of fueling his vehicle. Similar to FIG. 2C, transparent pane 230 automatically closes after a pre-determined time interval or after a sensing mechanism in hand sanitizer compartment 150 recognizes that the patron's hand has been removed from opening 155, or alternatively can be manually opened or closed and may be automatically unlocked when a patron completes fueling his vehicle and returns fuel pump 105 to return carriage 107 (and locked after the patron completes access of the hand sanitizer). It should be recognized that any combination of the features of any of FIGS. 2A-2D may be utilized in alternative embodiments of hand sanitizer compartment 150 consistent with the teachings herein.

Figure 3:
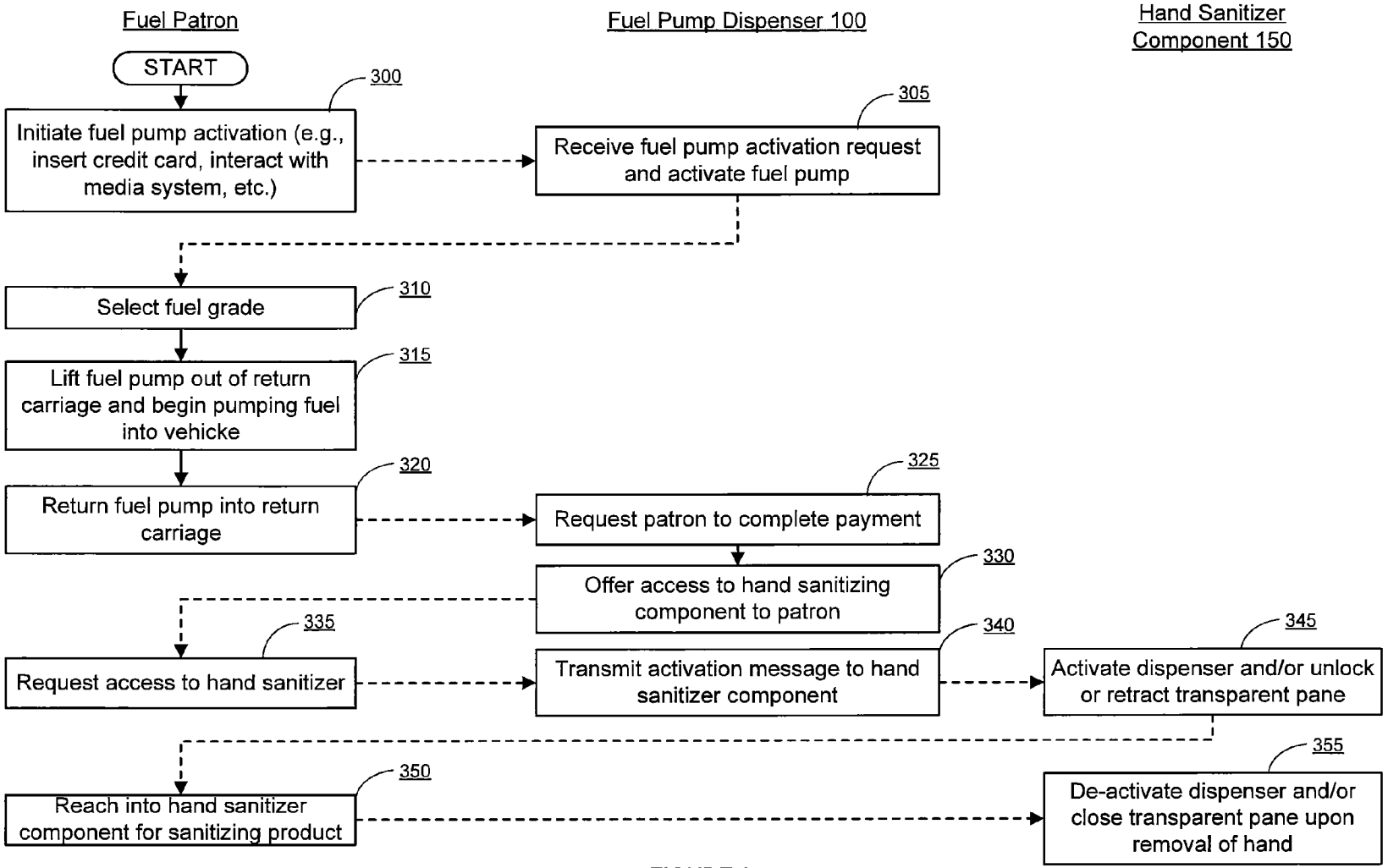
FIG. 3 depicts a flow chart for enabling a hand sanitizer device during a fuel pumping session.

FIG. 3 depicts a flow chart for enabling a hand sanitizer device during a fuel pumping session. In step 300, a patron requests activation of the fuel pump by inserting his credit card into bar scanner 125 or otherwise communicating with the media system of the fuel pump dispenser 100 by interacting with media system display 115. In response, fuel pump dispenser 100 receives the initiation request and activates the pump in step 305. In step 310, the patron selects a fuel grade and in step 315 lifts fuel pump 105 out of return carriage 107 and begins pumping fuel into his vehicle. In step 320, the patron completes pumping fuel into his vehicle and returns fuel pump 105 into return carriage 107. Once fuel pump 105 is placed in return carriage 107, fuel pump dispenser 100 recognizes that the patron has completed fueling and, in step 325, requests the patron to complete payment, for example, by displaying an offering for a receipt through media system display 115. In step 330, fuel pump dispenser 100 further offers the patron to clean his hands by accessing hand sanitizer compartment 150, for example, by displaying a message in media system display 115. In one embodiment, the offer in the message may ask whether the patron desires to purchase access to the hand sanitizer compartment 150, for example, for 10 cents (or any other reasonable amount), while in another embodiment, the offer may be free. In step 335, the patron requests access to hand sanitizer compartment 150 by interacting with media system display 115. In one embodiment, such an access request causes the fuel pump dispenser 100 to interact with an in-store point of sale terminal and/or store controller that assists in completion of a payment transaction for access to the hand sanitizer compartment 150.

In response, in step 340, fuel pump dispenser transmits an activation message to the hand sanitizer dispenser of hand sanitizer compartment 150. In step 340, the hand sanitizer dispenser is activated (e.g., if automatic) and if it has a transparent pane, the transparent pane is unlocked, retracted or otherwise opened. In step 345, the patron reaches into hand sanitizer compartment opening 155 and is dispensed sanitizing product (e.g., either a portion of product or a sealed on unsealed moist towelette, depending upon the embodiment of the hand sanitizer dispenser). In an embodiment that dispenses sealed moist towelettes, a single moist towelette may be automatically dispensed from the dispenser and dropped into opening 155. In step 350, the patron removes his hand and, in step 355, hand sanitizer compartment 150 closes the transparent pane or deactivates the dispenser (e.g., if automatic). In one embodiment, the media system of fuel pump dispenser 100 transmits a deactivation signal to hand sanitizer compartment 150 after a predetermined (and configurable) time interval. In such an embodiment, the hand sanitizer dispenser of hand sanitizer compartment 150 includes an activation and deactivation circuit to receive such messages from fuel pump dispenser 100. In an alternative embodiment, the hand sanitizer dispenser includes its own timing circuit which deactivates the dispenser's automatic dispensing capabilities after a predetermined (and configurable) amount of time. In an alternative embodiment, hand sanitizer compartment 150 includes an infrared or other motion sensor that recognizes the removal of the patron's hands and deactivates and sensor and/or closes the transparent pane upon such removal.

It should be recognized that various modifications and changes may be made to the specific embodiments described herein without departing from the broader spirit and scope of the invention as set forth in the appended claims. For example, rather than a having separate hand sanitizer compartment for each fuel pump dispenser at a fuel station, multiple fuel pump dispensers can share access to a standalone hand sanitizer compartment.

The various embodiments described herein may employ various computer-implemented operations involving data stored in computer systems. For example, these operations may require physical manipulation of physical quantities usually, though not necessarily, these quantities may take the form of electrical or magnetic signals where they, or representations of them, are capable of being stored, transferred, combined, compared, or otherwise manipulated. Further, such manipulations are often referred to in terms, such as producing, identifying, determining, or comparing. Any operations described herein that form part of one or more embodiments of the invention may be useful machine operations. In addition, one or more embodiments of the invention also relate to a device or an apparatus for performing these operations. The apparatus may be specially constructed for specific required purposes, or it may be a general purpose computer selectively activated or configured by a computer program stored in the computer. In particular, various general purpose machines may be used with computer programs written in accordance with the teachings herein, or it may be more convenient to construct a more specialized apparatus to perform the required operations.

The various embodiments described herein may be practiced with other computer system configurations including hand-held devices, microprocessor systems, microprocessor-based or programmable consumer electronics, minicomputers, mainframe computers, and the like.

One or more embodiments of the present invention may be implemented as one or more computer programs or as one or more computer program modules embodied in one or more computer readable media. The term computer readable medium refers to any data storage device that can store data which can thereafter be input to a computer system computer readable media may be based on any existing or subsequently developed technology for embodying computer programs in a manner that enables them to be read by a computer. Examples of a computer readable medium include a hard drive, network attached storage (NAS), read-only memory, random-access memory (e.g., a flash memory device), a CD (Compact Discs) CD-ROM, a CD-R, or a CD-RW, a DVD (Digital Versatile Disc), a magnetic tape, and other optical and non-optical data storage devices. The computer readable medium can also be distributed over a network coupled computer system so that the computer readable code is stored and executed in a distributed fashion.

Although one or more embodiments of the present invention have been described in some detail for clarity of understanding, it will be apparent that certain changes and modifications may be made within the scope of the claims. Accordingly, the described embodiments are to be considered as illustrative and not restrictive, and the scope of the claims is not to be limited to details given herein, but may be modified within the scope and equivalents of the claims. In the claims, elements and/or steps do not imply any particular order of operation, unless explicitly stated in the claims.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the invention(s). In general, structures and functionality presented as separate components in exemplary configurations may be implemented as a combined structure or component. Similarly, structures and functionality presented as a single component may be implemented as separate components. These and other variations, modifications, additions, and improvements may fall within the scope of the appended claims(s).

I claim:

1. A hand sanitizer device comprising:

a compartment embedded into a fuel pump dispenser; and a hand sanitizer dispenser in the compartment space, wherein the compartment comprises an opening into a recessed area of the fuel pump dispenser and a pane covering the opening.

2. The device of claim 1, wherein the pane is transparent and retractable upon an activation of the hand sanitizer dispenser by a computer system of the fuel pump dispenser.

3. The device of claim 2, wherein the device further comprises a sensor for sensing the presence of a hand in the opening that is configured to transmit a deactivation signal to the compartment upon sensing a removal of a hand from the opening in order to close the pane over the opening.

4. The device of claim 3, wherein the sensor is selected from the group consisting of a motion sensor and a infrared sensor.

5. A hand sanitizer device comprising:

a compartment embedded into a fuel pump dispenser; and a hand sanitizer dispenser in the compartment space, wherein the hand sanitizer dispenser comprises an activation circuit for activating dispensing capabilities of the dispenser and the activation circuit is configured to receive an activation signal from a computer system coupled to the fuel pump dispenser and activate the hand sanitizer dispenser in response to the receipt of the activation signal.

6. The device of claim 5, wherein the activation circuit is further configured to receive a deactivation signal from the computer system and deactivate the hand sanitizer dispenser in response to receipt of the deactivation signal.

7. The device of claim 5, wherein the hand sanitizer dispenser further comprises a timer circuit for initiating a predetermined time interval and deactivating the hand sanitizer dispenser upon an expiration of the time interval.

8. A fuel pump dispenser configured to provide hand sanitization after pumping fuel comprising:

a display for communicating with a patron;

a computer system coupled to the display; and a hand sanitizer compartment comprising a hand sanitizer dispenser coupled to the computer system, wherein the hand sanitizer compartment comprises an opening into a recessed area and a pane covering the opening.

9. The fuel pump dispenser of claim 8, wherein the pane is transparent and retractable upon an activation of the hand sanitizer dispenser by the computer system.

10. The fuel pump dispenser of claim 9, wherein the compartment further comprises a sensor for sensing the presence of a hand in the opening that is configured to transmit a deactivation signal to the compartment upon sensing a removal of a hand from the opening in order to close the pane over the opening.

11. A fuel pump dispenser configured to provide hand sanitization after pumping fuel comprising:

a display for communicating with a patron;

a computer system coupled to the display; and a hand sanitizer compartment comprising a hand sanitizer dispenser coupled to the computer system, wherein the hand sanitizer dispenser comprises an activation circuit for activating dispensing capabilities of the dispenser and the activation circuit is configured to receive an activation signal from a computer system and activate the hand sanitizer dispenser in response to the receipt of the activation signal.

12. The fuel pump dispenser of claim 11, wherein the computer system is configured to initiate a predetermined time interval and the activation circuit is further configured to receive a deactivation signal from the computer system upon expiration of the predetermined time interval and deactivate the hand sanitizer dispenser in response to receipt of the deactivation signal.

13. A fuel pump dispenser configured to provide hand sanitization after pumping fuel comprising:

a display for communicating with a patron;

a computer system coupled to the display; and a hand sanitizer compartment comprising a hand sanitizer dispenser coupled to the computer system, wherein the computer system is configured to transmit a payment transaction relating to access to the hand sanitizer dispenser to an in-store controller.

14. A method performed by a circuit of a hand sanitizer dispenser embedded in a fuel pump dispenser comprising:

receiving an activation signal from a computer system of the fuel pump dispenser;

activating a dispensing capability of the hand sanitizer dispenser;

dispensing a portion of sanitizer product upon recognizing the presence of a hand under the hand sanitizer dispenser;

sensing removal of the hand from under the hand sanitizer dispenser; and deactivating the dispensing capability of the hand sanitizer dispenser.

* * * * *